US006111252A

United States Patent [19]

Pierrejean

[11] Patent Number: 6,111,252

[45] Date of Patent: Aug. 29, 2000

[54] IONIZATION CELL FOR MASS SPECTROMETERS

[75] Inventor: Didier Pierrejean, Villaz, France

[73] Assignee: Alcatel, Paris, France

[21] Appl. No.: 09/108,176

[22] Filed: Jul. 1, 1998

[30] Foreign Application Priority Data

Jul. 3, 1997 [FR] France ..... 97 08440

[51] Int. Cl.[7] ..... H01J 49/00

[52] U.S. Cl. ..... 250/288; 250/423 R; 250/427

[58] Field of Search ..... 250/288, 423 R, 250/423 F, 427, 281

[56] References Cited

U.S. PATENT DOCUMENTS

| | | | |
|---|---|---|---|
| 3,852,595 | 12/1974 | Aberth | 250/288 |
| 4,272,699 | 6/1981 | Faubel et al. | 250/427 |
| 5,541,408 | 7/1996 | Sittler | 250/288 |

FOREIGN PATENT DOCUMENTS

4137527A1 5/1993 Germany .

OTHER PUBLICATIONS

Patent Abstracts of Japan, vol. 017, No. 608 (E–1457), Nov. 9, 1993 corresponding to JP 05 190148 A dated Jul. 30, 1993.

*Primary Examiner*—Kiet T. Nguyen

*Attorney, Agent, or Firm*—Sughrue, Mion, Zinn, Macpeak & Seas, PLLC

[57] ABSTRACT

A mass spectrometer ionization cell includes a micropoint type cold cathode which emits electrons, an amagnetic material anode forming an ionization cage positively biased relative to the cathode and including an entry slot for emitted electrons facing the cathode, and an ion collector electrode which is held at a potential lower than that of the cathode. The electrode is disposed laterally of and outside the space between the cathode and the anode and extends from the cathode to the anode. An axial magnetic field is generated in the cathode-anode direction.

1 Claim, 1 Drawing Sheet

IONIZATION CELL FOR MASS SPECTROMETERS

BACKGROUND OF THE INVENTION

1. Field of the invention

The present invention concerns an ionization cell for mass spectrometers.

In particular, the invention applies to mass spectrometers in which the heated electrical filament emitting electrons is replaced by a cold cathode of the micropoint type.

2. Description of the Prior Art

The advantages of a cold cathode over a tungsten filament heated to 1,800° C. are well known:

- the very high energy efficiency, which is practically 100%, each electron emitted having been taken from the emitting source in a ratio 1/1, unlike the tungsten filament that has to be heated with a high current for it to be able to emit electrons by a thermo-electronic effect; the orders of magnitudes of the powers employed are 10 W for a heated filament compared to 0.2 W for a cold source,
- the rapid reaction of the device, both on turning it on and on turning it off: in the case of sudden air entry, the system can be deactivated instantaneously, unlike a tungsten filament that will burn because of its thermal inertia; this rapid reaction additionally makes it feasible to cut off the power supply to the device when the instrument is not in measuring mode and to turn it on again to carry out a measurement,
- the directionality of the emitted beam: the electrons are emitted perpendicularly to the surface of the micropoint array, unlike a filament in which the electrons are emitted in all directions, and
- the absence of heat dissipation: the device emitting electrons by the field effect does not generate any heat and consequently does not disturb the operation of the temperature-sensitive detection pre-amplifiers.

However, reliability and operational capability are not assured at pressures in the order of $10^{-4}$ mbar.

At this pressure and above, the micropoint type cold cathode is degraded because of the excessively high number of ions formed between the cathode and the anode, constituting an ionization cage. The positive ions formed between the cathode and the ionization cage return to the negative cathode.

SUMMARY OF THE INVENTION

The aim of the present invention is to overcome this drawback and the present invention consists of a mass spectrometer ionization cell comprising a micropoint type cold cathode adapted to emit electrons, an amagnetic material anode forming an ionization cage positively biased relative to the cathode and including an entry slot for emitted electrons facing the cathode, and an ion collector electrode adapted to be held at a potential lower than that of the cathode and disposed laterally of and outside the space between the cathode and the anode, extending from the cathode to the anode, wherein an axial magnetic field is generated in the cathode-anode direction.

One embodiment of the invention will now be described with reference to the appended drawing.

DETAILED DESCRIPTION OF THE PREFERRED EMBODIMENT

Figure 1:
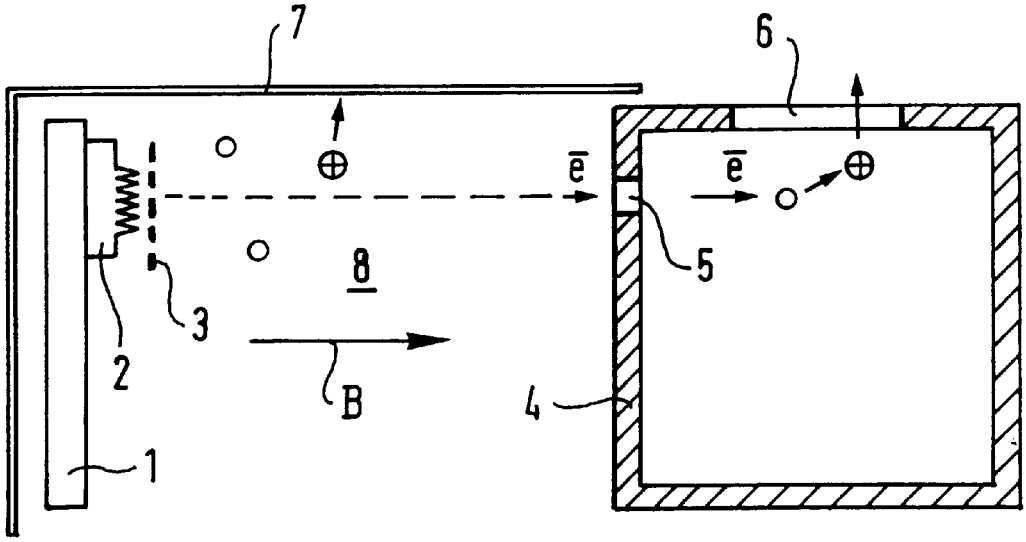
FIG. 1 is a diagram showing an ionization cell in accordance with the invention.

Referring to FIG. 1, an ionization cell in accordance with the invention comprises a ceramic substrate 1 supporting a micropoint type cold cathode 2 associated with a grid 3, an amagnetic material anode 4 in the form of a parallelepiped-shape box forming a Faraday cage, constituting an ionization cage and having an entry slot 5 for electrons emitted by the cold cathode 2 and an extraction slot 6 for the ⊕ ions formed in the ionization cage.

Extraction of ions via the extraction slot 6 and selection of ions do not constitute any part of the invention and are effected in a conventional way, for example in the same manner as in analysis cells in which electrons for the production of ions are emitted by a heated filament.

In accordance with the invention, to prevent the ions formed between the cold cathode 2 and the anode-ionization cage 4 returning to the points of the cathode and degrading them, an ion collector electrode 7 is provided and held at a potential less than that of the cold cathode 2.

The ion collector electrode 7 captures all the ions formed between the cathode 2 and the anode 4.

As shown in FIG. 1, the electrode 7 is disposed laterally of and outside the space 8 between the cathode 2 and the anode 4 and extends over all of the distance between the cathode 2 and the anode 4. For ease of mechanical connection, the electrode 7 is bent behind the support substrate 1 and the whole is fixed to a frame, not shown. In order for the electrons emitted by the cathode 2 to be directed towards the entry slot 5 of the anode-ionization cage 4 an axial magnetic field β is generated in the cathode-anode direction shown by the arrow. Without this field, because of the electrode 7, the electrons would be deflected by the electrostatic field created by the collector electrode 7.

The magnetic field β is created by an electromagnetic coil or by magnets, not shown.

In FIG. 1 the symbol ⊕ represents a positive ion, the symbol ○ represents a neutral molecule and $e^-$ represents an electron.

Figure 2:
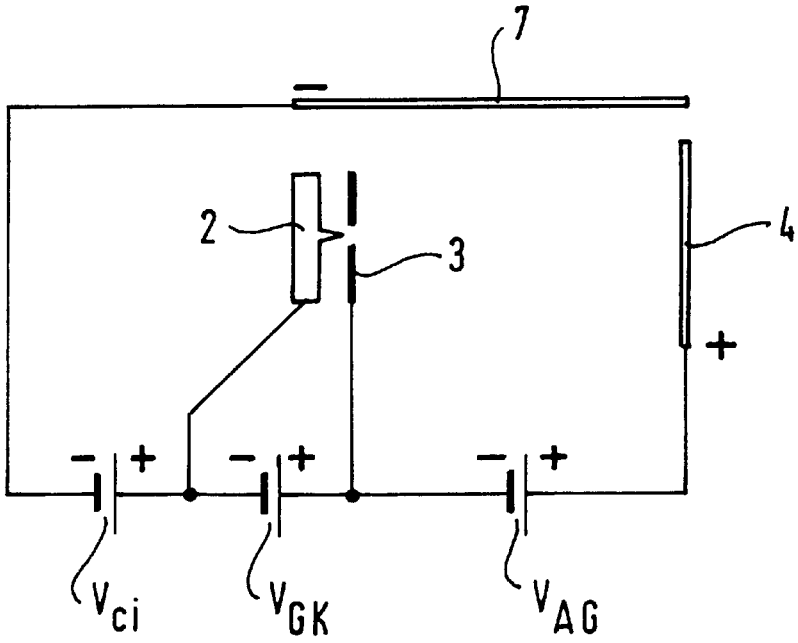
FIG. 2 is a circuit diagram showing the electrical connections of the components from FIG. 1.

FIG. 2 shows the electrical connections of the various electrodes.

The voltages between the electrodes can be, for example:

$V_{ci}$: 80 V $V_{GK}$: 50–100 V $V_{AG}$: 80 V.

What is claimed is:

1. A mass spectrometer ionization cell comprising:

a micropoint cold cathode which emits electrons, an amagnetic material anode forming an ionization cage positively biased relative to said cathode and including an entry slot for receiving the emitted electrons facing said cathode, an ion collector electrode held at a potential lower than that of said cathode and disposed laterally of and outside a space between said cathode and said anode, extending from said cathode to said anode, and an axial magnetic field generated in a cathode-anode direction.

* * * * *